US008062381B2

(12) United States Patent
Shamayeli et al.

(10) Patent No.: US 8,062,381 B2
(45) Date of Patent: Nov. 22, 2011

(54) LIQUID MEMBRANE COMPATIBLE DETERGENT FORMULATION COMPRISING BRANCHED ALKOXYLATED FATTY ALCOHOLS AS NON-IONIC SURFACTANTS

(75) Inventors: Khalil Shamayeli, Düsseldorf (DE); Thomas Merz, Hilden (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/663,132

(22) PCT Filed: Jun. 4, 2007

(86) PCT No.: PCT/EP2007/055483

§ 371 (c)(1), (2), (4) Date: May 25, 2010

(87) PCT Pub. No.: WO2008/148420

PCT Pub. Date: Dec. 11, 2008

(65) Prior Publication Data

US 2010/0257676 A1 Oct. 14, 2010

(51) Int. Cl.

| | |
|---|---|
| ***B08B 3/04*** | (2006.01) |
| ***C11D 1/72*** | (2006.01) |
| ***C11D 1/722*** | (2006.01) |
| ***C11D 1/825*** | (2006.01) |
| ***C11D 3/37*** | (2006.01) |
| ***C11D 7/06*** | (2006.01) |

(52) U.S. Cl. ..... 8/137; 510/339; 510/340; 510/356; 510/360; 510/417; 510/421; 510/435; 510/475

(58) Field of Classification Search ..... 510/339, 510/340, 356, 360, 417, 421, 435, 475; 8/137
See application file for complete search history.

(56) References Cited

U.S. PATENT DOCUMENTS

2007/0123447 A1 5/2007 Killeen et al.

FOREIGN PATENT DOCUMENTS

| | | |
|---|---|---|
| DE | 3928601 | 7/1991 |
| DE | 19548843 | 7/1997 |
| WO | WO2004/099355 | 11/2004 |
| WO | WO 2007/101470 | * 9/2007 |

* cited by examiner

*Primary Examiner* — Brian P Mruk
(74) *Attorney, Agent, or Firm* — Merchant & Gould P.C.

(57) ABSTRACT

The invention relates to a liquid detergent concentrate composition comprising an emulsion having an aqueous phase and an oil phase, the composition comprises based on the whole concentrate 1 to 50 wt-% of one or more alkalinity source, 1 to 60 wt-% of a guerbet alcohol ethoxylate of the formula $R_1$—$(OC_2H_4)_n$—OH, wherein $R_1$ is a branched $C_8$ to $C_{10}$ alkyl group and n is from 2 to 10, 1 to 30 wt-% of a linear alkoxylated fatty alcohol of the formula $R_2$—$(OC_2H_4)_x$—$(OC_3H_6)_y$—OH, wherein $R_2$ is a linear $C_{10}$ to $C_{16}$ group and x is from 3 to 7 and y is from 3 to 7. 0.01-10 wt-% of one or more crosslinked or partly crosslinked polyacrylic acid Q or polymethacrylic acid or mixtures thereof and the rest up to 100 wt-% is water.

22 Claims, 1 Drawing Sheet

LIQUID MEMBRANE COMPATIBLE DETERGENT FORMULATION COMPRISING BRANCHED ALKOXYLATED FATTY ALCOHOLS AS NON-IONIC SURFACTANTS

The invention relates to a liquid detergent composition concentrate, to a stable aqueous use solution comprising the liquid detergent concentrate composition, and to a method for washing textiles. The liquid detergent composition can be provided as a concentrate or as a use solution. The liquid detergent composition in the form of the concentrate or the use solution is an emulsion of the water-in-oil-type emulsion or oil-in-water emulsion, dependent on the amounts of water and oil in the emulsion.

BACKGROUND OF THE INVENTION

In institutional and industrial washing processes the wastewater of the washing process is usually cleaned and purified by using membrane filtration units. The obtained purified water can then be re-used in another washing cycle. The use of a membrane filtration process for the cleaning of wastewater results in a decrease of the amount of fresh water required to be added to the washing cycle and accordingly in a reduction of costs and saving resources. Also from an environmental point of view the use of membrane filtration is advisable.

However, the membrane cleaning processes can only be applied for wastewater which does not contain components blocking the membrane of the membrane filtration unit. Therefore it is necessary to use membrane-compatible detergents in these washing processes which do not contain any membrane-blocking or membrane-destroying components.

In the state of the art membrane-compatible detergent compositions are already known. However, most of these detergents are detergents in paste form having a high viscosity.

WO 2005/118760 A1 describes for example a membrane-compatible pasty soap composition which is used in a washing process in which the wastewater is purified by a membrane filtration unit and especially in a membrane filtration unit comprising one or more reverse osmosis steps. The detergent comprises anionic surfactants, non-ionic surfactants, an alkalinity source, and an organic and/or inorganic builder on a non-silicate basis. Furthermore the composition is free of greying inhibitors on a cellulose basis, silicates, and phosphates.

As non-ionic surfactants linear fatty alcohol alkoxylates are used which are ethoxylated. Furthermore the composition comprises alkyl polyglycoside having 8 to 14 carbon atoms.

The paste has a high viscosity preferably being between 30,000 to 60,000 mPas at 50 revolutions per minute measured using a Brookfield rotational viscosimeter with spindle no. 7 at 25° C.

A further paste-like detergent is described in WO 02/46351 A1. This detergent is also used in a washing process in which the accumulated wastewater is cleaned by a filtration process using a membrane filtration unit.

The use of detergents in paste form in washing processes has the disadvantage that expensive dosing units are necessary to pump the high viscous paste into the institutional and industrial washing machines. Therefore there is a need for providing a liquid membrane-compatible detergent concentrate having a low viscosity being able to be pumped through the washing device by using standard pumping units which are less expensive.

Liquid detergents are known from the state of the art. Such detergents are, for example, described in U.S. Pat. No. 5,880,083, WO 2004/065535 A1, and WO 2004/041990 A1. However, the liquid detergents being used in the state of the art often contain components causing the blocking of the membrane filtration unit and hence cannot be used for washing processes in which membrane filtration units are used for the cleaning of the wastewater. Those components, if used in high amounts, are for instance cationic surfactants, certain emulsifiers, carboxymethylcellulose and silicates. These components immediately block the membrane and lead to an interruption of the whole washing process. By leaving out such components the stability of the liquid detergent composition which normally is an emulsion or dispersion decreases. This decreased stability results in a separation of the emulsion or the dispersion after storage or when used at extremely different temperatures. Separated emulsions or dispersions cannot be used in the washing process and cannot be dosed applying the usual dosing units.

PCT/EP2006/060465 which is an earlier application describes a liquid detergent composition being membrane-compatible. The composition is storage-stable and shows a good washing performance. As non-ionic surfactants linear alkoxylated alcohols are used in the detergent composition. These are, for example. linear fatty alcohol ethoxylates having a $C_{13}$-$C_{15}$ alkyl group and 7 EO units. These non-ionic surfactants are, for example, available under the trade name Lutensol AO7 from BASF.

These linear non-ionic surfactants, however, have the disadvantage of being classified as highly toxic for water organisms. During transport they have to be declared as polluting substances.

Therefore it is necessary to replace such kinds of non-ionic surfactants by other surfactants which are also membrane-compatible resulting in a similar storage stability and washing performance and are environmentally more acceptable.

SUMMARY OF THE INVENTION

The technical object of the invention is to provide a liquid membrane-compatible detergent as an emulsion comprising only components which do not effect the filtration process in the membrane-filtration unit for the waste wash water of the washing process which, nevertheless, are stable emulsions which do not separate in several phases after being stored or when used at extremely different temperature.

Furthermore the non-ionic surfactants being used in the detergent composition should not be toxic for water organisms which could lead to major problems when disposing the waste water of the washing process.

The technical object of the invention is solved by a liquid detergent concentrate composition comprising an emulsion having an aqueous phase and an oil phase and the composition comprises, based on the whole concentrate, 1 to 50 wt-%, preferably 5 to 40 wt-% and most preferred 10 to 30 wt-% of one or more alkalinity source, 1 to 60 wt-%, preferably 5 to 50 wt-%, more preferred 7 to 40 wt-% and most preferred 10 to 30 wt-% of a guerbet alcohol ethoxylate of the formula $R_1$—$(OC_2H_4)_n$—OH, wherein $R_1$ is a branched $C_9$ to $C_{20}$ alky I group, preferably a branched C10 to C18 alkyl group and n is from 2 to 1.0, preferably 5 to 9, 1 to 30 wt-%, preferably 5 to 35 wt-%, more prefereed 7 to 25 wt-%, and most preferred 9 to 15 wt-% of a linear ethoxylated/propoxylated fatty alcohol of the formula $R_2$—$(OC_2H_4)_x$—$(OC_3H_6)_y$—OH, wherein $R_2$ is a linear $C_{10}$ to $C_{16}$ group and x is from 3 to 7 and y is from 3 to 7, 0.01-10 wt-%, preferably 0.1 to 5 wt-%, more preferred 0.2 to 2 wt-% and most preferred 0.3 to 0.9 wt-% of one or more cross linked or partly cross linked polyacrylic acid or polymethacrylic acid or mixtures thereof, and the rest. up to 100 wt-% is water.

DETAILED DESCRIPTION OF THE INVENTION

Figure 1:
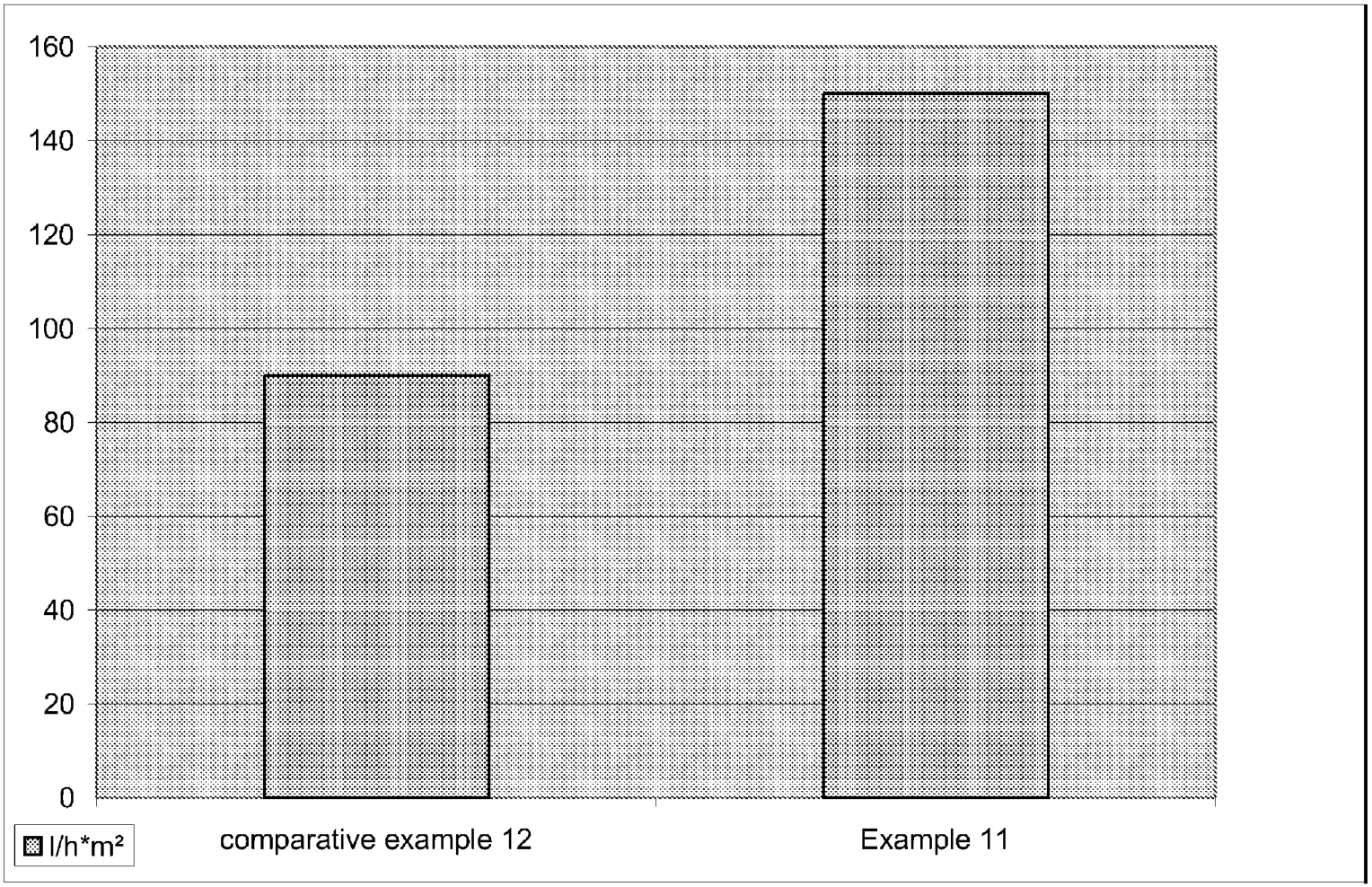
FIG. 1 shows the membrane compatibility of the composition according to example 11 being compared with the composition according to comparative example 12.

Surprisingly if was found that the linear ethoxylated alcohol can be replaced by Guerbet alcohol ethoxlate comprising branched alkyl groups instead of linear alkyl groups. These non-ionic Surfactants are environmental friendly and are classified as non-polluting substances. During experiments with a Guerbet alcohol ethoxylates it was found that the membrane compatibility of these non-ionic surfactants is even higher compared to the usual linear ethoxylated fatty alcohols.

The use of Guerbet non-ionic surfactants in washing detergent compositions is known, for example, from WO 96/12782A1. However, the non-ionic surfactants are used in this reference for controlling the sudsing of a detergent composition.

The liquid detergent concentrate provides an increased hydrophobic greasy and oily stain removal and therefore is preferably used for the cleaning of fabrics preferably work wear.

The liquid detergent concentrate composition according to the invention only contains components which do not affect the filtration process in the membrane filtration unit and do not block the membrane. Furthermore the liquid detergent concentrate composition according to the invention is a stable emulsion which does not separate when being stored. The emulsion is also stable at lower temperatures, for example −15° C. If the emulsion is frozen at temperatures below −20° C. and melted thereafter, the emulsion is formed again without the need of stirring the composition. This is particularly important when the emulsion is stored outside, for example in the wintertime, when outside temperatures are below −10° C. Even under these extreme conditions the liquid detergent concentrate composition according to the invention is a stable emulsion, does not separate and recovers completely at ambient temperatures.

Usually the detergent composition is available as a concentrate and/or shipped or stored as a concentrate in order to avoid expenses associated with shipping and/or storing a composition containing a large amount of water.

The concentrate is then normally diluted at the location of use to provide a use solution. Furthermore it is also possible to first dilute the concentrate in order to provide a more diluted concentrate. A ready-to-use composition is then prepared by further diluting the diluted concentrate.

The liquid detergent composition comprises one or more alkalinity sources in an amount of 1-50 wt. %, preferably 5 to 40 wt. % and most preferred 10 to 30 wt, %. The alkalinity source can be an alkali hydroxide, preferably sodium hydroxide and/or potassium hydroxide. Sodium metasilicate or other silicates can not be used as an alkalinity source, since such silicates are not membrane-compatible and will block the membrane. Therefore it is preferred that the liquid detergent concentrate composition does not contain silicates.

The grade of alkalinity in the present concentrate composition is higher than in usual household detergent concentrate compositions where higher amounts of silicates, alkali metal hydroxide, sodium carbonates or sodium hydrogen carbonates are used as alkalinity sources.

The liquid detergent concentrate composition according to the invention further comprises 1 to 60 wt. %, preferably 5 to 50 wt. %, more preferred 70 to 40 wt. % and most preferred 10 to 30 wt. % of a non-ionic surfactant. The non-ionic surfactant is a Guerbet alcohol ethoxylate of the formula $R^1$—$(OC_2H_4)_n$—(OH), wherein $R^1$ is a branched $C_9$-$C_{20}$ alkyl group and n is from 2 to 10.

20 In a preferred embodiment the guerbet alcohol ethoxylate being used in the liquid detergent concentrate composition is a mixture of two different guerbet alcohol ethoxlyates of the formula $R^1$—$(OC_2H_4)_n$—OH, wherein for the first guerbet alcohol ethoxylate $R^1$ is a branched $C_{10}$ to $C_{18}$ alkyl group and n is from 5 to 10, preferably 7 to 9 and wherein for the second guerbet alcohol $R^1$ is $C_8$ to $C_{12}$ branched alkyl group, preferably branched $C_{10}$ alkyl group and n is 2 to 4, preferably 3. Such guerbet alcohols are available, for example, under the trade name Lutensol from BASF or Eutanol G from Cognis.

The guerbet reaction is a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidised to an aldehyde. Then Aldol condensation takes place after proton extraction. Thereafter the aldol product is dehydrated and the hydrogenation of the allylic aldehyde takes place.

These products are called guerbet alcohols and are further reacted to the non-ionic alkoxylated guerbet alcohols by alkoxylation with i.e. ethylene oxide or propylene oxide. The ethoxylated guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the guerbet alcohol in solution and the resulting emulsion stable even over a longer storage time. This result is surprisingly achieved by the use of one or more crosslinked or partly crosslinked polyacrylic acids and/or polymethacrylic acids in the composition.

The liquid detergent concentrate composition according to the invention further comprises 1-30 wt. %, preferably 5-35 wt. %, more preferred 7 to 25 wt. % and most preferred 9-15 wt. % of a linear alkoxylated fatty alcohol of the formula $R^2$—$(OC_2H_4)_X$—$(OC_3H_6)_Y$—(OH) in a preferred embodiment the ethoxylated/propoxylated fatty alcohol includes $C_{12}$-$C_{14}$ alcohols containing 5 EO (ethylene oxide) units and 4 PO (propylene oxide) units. These fatty alcohol alkoxylates are, for example, available as Dehypon LS54 from Cognis.

The non-ionic surfactants are used to provide the resulting use solution with a desired detersive property.

A further component of the liquid detergent concentrate composition is 0.01 to 10 wt. %, preferably 0.05 to 8 wt. %, most preferred 0.1 to 5 wt. % of one or more crosslinked or partly crosslinked polyacrylic acids and/or polymethacrylic acids. This substance is used as thickener and stabiliser for a liquid detergent concentrate composition which is an emulsion. In a preferred embodiment polyacrylic acid or polymethacrylic acid is crosslinked or partly crosslinked with a polyalkenyl polyether compound as crosslinker. Those compounds are available under the trade name Carbopol® from Noveon.

The liquid detergent concentrate composition according to the invention has a viscosity in the range of from 500 to 10,000 mPas, preferably 600 to 6,000 mPas, and most preferred from 700 to 5,000 mPas at 20° C. measured at 20 revolutions per minute on a Brookfield RVT viscosimeter with spindle no. 2. This low viscosity allows it to pump the liquid detergent concentrate by using standard pumping devices and it is not necessary to use specific pumping devices for high-viscous liquids. Because of the low viscosity of the product can be dosed by usual standard peristaltic pumps which are much cheaper than pumps for higher viscous fluids.

As mentioned above the liquid detergent concentrate composition according to the invention is a membrane-compatible composition. That means that it does not contain any components destroying or blocking the membrane which is used for the cleaning of the wastewater in the washing process. Therefore the liquid detergent concentrate composition according to the invention does not contain any cationic surfactant. Exemplary cationic surfactants which are not contained in the liquid detergent concentrate composition according to the invention include quaternary ammonium compounds, amine salts, and mixtures thereof.

There are other compounds which are normally used in liquid detergents also having a negative effect on the membrane filtration unit if they are present in higher amounts.

In a preferred embodiment the liquid detergent concentrate composition according to the invention contains alkyl polyglycoside as emulsifying agent in an amount less than 1 wt. %. Preferably no alkyl polyglycoside is present. Alkyl polyglycoside is used as an emulsifier in detergent compositions. However, alkyl polyglycosides tends to foam building in the detergent composition and thus lower the washing performance of the detergent. Furthermore the building of foam has a negative influence on the membrane filtration unit as a liquid with foam on it is difficult to filter in the membrane filtration unit.

The same applies to a further component normally used in other liquid detergents, namely fatty acid soaps. Fatty acid soaps are often used as inorganic surfactants in liquid detergents. However, similar to alkyl polyglycoside, fatty add soaps tend to accelerate the building of foam especially in soft water. Therefore, in a preferred embodiment the amount of fatty acid soap in the concentrate composition according to the invention is lower than 1 wt. %, preferably no fatty acid soap is present in the liquid detergent concentrate composition according to the invention. Besides sodium or potassium soaps form lime soaps in the presence of hard water. Lime soaps are water insoluble and block membranes.

In a further preferred embodiment the composition according to the invention comprises less than 1 wt. % of complexing agents, selected from the group of nitrilo triacetic acids (NTA) ethylenediamine tetraacetic acid (EDTA) and hydroxyethylenediamine tetraacetic acid (HEDTA). Preferably the composition does not comprise any of the three components. Especially NTA is suspected to be a carcinogenic substance and therefore its use will probably strictly be limited in the future. The amount of ETDA, NTA and HEDTA in the composition is preferably less than 1 wt. %, most preferred less than 0.1 wt. %, more preferred less than 0.01 wt. % and most preferred the compositions is free of ETDA, NTA and HEDTA.

Furthermore the composition comprises less than 2.5 wt-% of phosphor containing compounds, preferably less than 1 wt. %, most preferred less than 0.1 wt. %, more preferred less than 0.01 wt. % and most preferred the composition is free of P containing compounds.

In a preferred embodiment the liquid detergent concentrate according to claim 1 comprises less than 1 wt. %, preferably less than 0.1wt. %, more preferred less than 0.01 wt. % and most preferred 0 wt. % of a linear alcohol ethoxlyate of the formula ao $R^3$—$(OC_2H_4)_Z$—(OH), wherein $R^3$ is a linear $C_{10}$ to $C_{16}$ alkyl group and z is from 3 to 9. As stated above these kinds of linear non-ionic surfactants are toxic for water organisms and, as a consequence, they should, not be used in future detergent compositions.

In a preferred embodiment the liquid detergent concentrate composition compries as complexing agents iminodisuccinate salts and/or methyl glycine diacetic acid salt. Preferably the ratio of the mixture of iminodisuccinate salt to methyl glycine diacetic acid salt is from 6 to 1 to 1 to 1, preferably 2 to 1.

The liquid detergent composition according to the invention has a high stability when stored at room temperature over a longer period of time. The emulsion is even stable under very cold conditions below 15° C. where the emulsion does not separate.

In a preferred embodiment the droplet size of the emulsion is less than 25 μm, preferably less than 15 μm.

In a further preferred embodiment the content of water in the liquid detergent concentrate composition is between 5 and 40 wt. %, preferably 10 to 25 wt. %.

As the liquid detergent concentrate composition is preferably used as a detergent for institutional and industrial washing the detergent does not contain any bleaching agents. In institutional and industrial washing processes the bleaching agent is normally dosed separately from the detergent. Normally bleaching agents are present in powder household detergents.

The liquid detergent concentrate composition according to the invention is as a concentrate as well as a use solution highly alkaline because it contains high amounts of an alkalinity sources. The pH range of the use solution is 11 to 14, preferably 12 to 14. The pH range of the concentrate is 13-14, preferably pH 14. This pH value is by far higher compared to the normal household washing detergents.

The emulsions according to the invention show a viscoelastic behaviour. The emulsion is stable about one year at room temperature and about four months at 40° C. The emulsion achieves a very high performance level compared to similar liquid detergent concentrates which are not compatible with membrane filtration processes. Furthermore the product fulfils important environmental requirements especially in the European countries because it does not contain in a preferred embodiment EDTA as complexing agent.

The product according to the invention is characterised by a high amount of non-ionic surfactant, a high alkalinity, and a high stability at temperatures lower 0° C. preventing the product from separating at lower temperatures. The product is staying stable for a long time and does not separate into different phases nor shows precipitations.

Furthermore the liquid detergent concentrate composition preferably does not contain carboxymethylcellulose, which is used as greying inhibitor in usual detergents. This compound blocks the membrane of the membrane filtration unit.

The liquid detergent concentrate according to the invention can furthermore contain usual additives selected from the group consisting of builders, pH modifiers, antimicrobial agents, abrasives, anti-redeposition agents, sequestrants, softener, conditioner, viscosity modifying agents, wetting modifying agents, enzymes, optical brightener and mixtures thereof.

Builders and sequestrants that can be used as components include organic builders, inorganic builders, and mixtures thereof. Exemplary organic builders include organic compounds such as the salts or the acid form of nitriloacetic acid and its derivatives, amino carboxylates, organic phosphonates, amides, polycarboxylates, salicylates and their derivatives, derivatives of polyamino compounds or mixtures thereof. Examples of nitriloacetic acid derivatives include sodium nitriloacetate and magnesium nitriloacetate. Exemplary aminocarboxylates include sodium iminosuccinates. Exemplary organic phosphonates include amino tri(methylenephosphonate), hydroxyethylidene diphosphonate, diethylenetriamine penta(methylenephosphonate), ethylenediamine tetra(methylenephosphonate), and 2-phosphonobutane-1,2,4-tricarboxylate (Bayhibit AM by Bayer). Exemplary polycarboxylates include citric acid and its salt and derivatives, sodium glutarate, potassium succinate, and polyacrylic acid and its salts and derivatives and copolymers. Exemplary polyamino compounds include diethyltriaminepentaacetic acid (DPTA), hydroxyethylene diamine, and salts and derivatives thereof. Exemplary organic builders include at least one of a builder selected from polyacrylates or their copolymers, iminodisuccinate, citrate, ethylenediamine or triamine derivatives, and mixtures thereof. Exemplary inorganic builders include sodium tripolyphosphate, sodium carbonate, sodium pyrophosphate, potassium pyrophosphate. When the detergent composition includes builders and sequestrants the builders and sequestrants can be provided in an amount of between 5 wt. % and 30 wt. %, preferably between 10 wt. % and 20 wt. %, based on the weight of the detergent composition.

Exemplary antimicrobials that can be used as the suspended particulate component include alkyl parabens such as methyl paraben and propyl paraben; phenolic derivatives such as t-amylphenol; metals and their oxides and salts such as silver, silver iodide, zinc oxide; halogenated hydantoin derivatives such as bromochlorodimethylhydantoin, dichlorodimethylhydantoin, dibromodimethylhydantoin; hypohalites such as calcium hypochlorite, sodium hypobromite; and oligomers or polymers such as povidone iodine or povidone peroxide.

When the detergent composition includes antimicrobials as the suspended particulate component, the antimicrobials can be provided in an amount of between about 0.001 wt. % and about 3 wt. % and between about 0.5 wt. % and about 2 wt. %, based on the weight of the detergent composition.

Exemplary pH modifiers that can be used as the suspended particulate component include inorganic acidic compounds like sodium hydrogen sulfate, calcium hydrogen phosphate, organic acid compounds like carboxylic acids such as oxalic acid, polyacrylic acid, inorganic alkaline compounds like hydroxides, carbonates, and organic When the detergent composition includes pH modifiers as the suspended particulate component, the pH modifiers can be provided in an amount of between about 1 wt. % and about 30 wt. % and between about 5 wt. % and about 15 wt. %, based on the weight of the detergent composition.

Exemplary abrasives suitable for use as the suspended particulate component include calcium carbonate, talc, sodium, pieces of polymeric material such as shredded polyethylene or polypropylene, and pumice. When the detergent composition includes abrasives as the suspended particulate component, the abrasives can be provided in an amount of between about 0.5 wt. % and about 10 wt. % and between about 1 wt. % and about 5 wt. %, based on the weight of the detergent composition.

Exemplary anti-redeposition agents that can be used as the suspended particulate component include polyacrylates and their copolymers. When the detergent composition includes anti-redeposition agents as the suspended particulate component, the anti-redeposition agents can be provided in an amount of between about 0.1 wt. % and about 10 wt. % and between about 1 wt. % and about 5 wt. %, based on the weight of the detergent composition.

Exemplary softeners or conditioners that can be used as the suspended particulate component include both fabric and skin softeners. Exemplary softeners include fatty alcohols, fatty esters, fatty alcohols, glycerine, vitamins, and amino acids. When the detergent composition includes softeners or conditioners as the suspended particulate component, the softeners or conditioners can be provided in an amount of between about 1 wt. % and about 30 wt. % and between about 5 wt. % and about 20 wt. %, based on the weight of the detergent composition.

Exemplary viscosity modifiers that can be used as the suspended particulate component include alkanolamides, alkanolamines, inorganic bases and acids, When the detergent composition includes viscosity modifiers as the suspended particulate component, the viscosity modifiers can be provided in an amount of between about 0.1 wt. % and about 5 wt. % and between about 0.5 wt. % and about 2 wt. %, based on the weight of the detergent composition.

Exemplary wetting modification agents that can be used as the suspended particulate component include: EO-PO derivatives and silane derivatives.

When the detergent composition includes wetting modification agents as the suspended particulate component, the wetting modification agents can be provided in an amount of between about 0.1 wt. % and about 5 wt. % and between 0.5 wt. % and about 3 wt. %, based on the weight of the detergent composition.

Exemplary enzymes that can be used as the suspended particulate component include proteases, lipases, amylases, cellulases, oxydases, peroxydases, esterases, and mixtures thereof. The liquid detergent concentrate can include an enzyme in an amount of between 0.1 wt. % and 2 wt. %, and between 0,5 wt. % and 1 wt. %.

The liquid detergent concentrate composition according to the invention optionally contains an anionic surfactant in an amount of 0 to 15 wt. %, preferably of from 0.5 to 8 wt. % which may be selected from the compounds comprising C8-C18 alkyl sulfates, C8-C18 alkyl ether sulfates, C8-C18 alkyl sulfonates, C8-C18 α-olefine sulfonates, sulfonated C8-C18 fatty acids, C8-C18 alkyl benzene sulfonates, sulfosuccinate mono and di C1-C12 alkyl esters, C8-C18 alkyl polyglycol ether caboxylates, C8-C18 n-acyl taurides, C8-C18 n-sarcosinates, C8-C18 alkyl isothionates, and mixtures thereof.

The liquid detergent concentrate includes a sufficient amount of water which is in the liquid detergent concentrate composition between 5 and 40 wt. %, preferably 10 to 25 wt. % related to the whole detergent concentrate.

In general a stable emulsion is characterised by a lack of phase separation when the emulsion is allowed to stand at room temperature for at least seven days. Emulsions with a better performance will not phase separate when allowed to stand at room temperature for at least fourteen days and preferably at least 30 days.

The present liquid detergent concentrate according to the invention has an even higher stability which is one year at 20° C. and four months at 40° C.

The liquid detergent concentrate can be diluted with water to provide the use solution. The step of diluting can take place by pumping into a water stream, aspirating into a water stream, pouring into water or by combining water with the concentrate. In a preferred embodiment the use solution comprises the liquid detergent concentrate according to the invention in a concentration of 0.5 to 25 wt-%, preferably 1 to 10 wt-% based on the detergent use solution.

The liquid detergent concentrate composition is preferably an emulsion. This liquid detergent concentrate composition according to the invention is prepared by mixing the solid and the fluid components of the detergent composition when the solid phase is dispersed in the liquid phase as homogeneous as possible. By thoroughly mixing the components and grinding the resulting mixture an emulsion is prepared having a homogeneous distribution of the water and oil phase in the emulsion. During this process the solid parts of the composition are solved in the solvent.

The liquid detergent concentrate composition according to the invention is used for washing textiles. The method for washing textiles comprises providing the liquid detergent, diluting the liquid detergent to a stable aqueous use solution in a concentration of 0.5 to 25 wt. %, preferably 1 to 10 wt-% based on the whole use solution and washing the textiles in an institutional or household washing machine in the detergent use solution. In a preferred embodiment the wastewater of the washing process is accumulated during the washing process and purified using membrane filtration unit.

The liquid detergent concentrate composition according to the invention has the advantage that the concentrate allows purification of wastewater which is accumulated during the cleaning or washing process using common membrane filtration units without blocking them or causing other damage to the membrane. The membrane filtration may as well comprise at least one ultrafiltration and/or reverse osmosis step. Said purification processes succeed best with the concentrate according to the invention.

In addition the liquid detergent concentrate composition according to the invention is a highly stable emulsion which does not separate when stored for one year at 20° C. Furthermore the emulsion is even stable at lower temperatures below 0° C. or under freeze and thaw conditions.

The inventive composition and the method according to the invention will be further described in the following examples which are meant to exemplify the present invention without restricting its scope. In the following all amounts mentioned refer to wt. % based on the whole liquid detergent concentrate composition unless otherwise indicated.

EXAMPLES

Example 1

Composition of the Detergent Concentrate

Table 1 describes specific examples of the liquid detergent concentrate composition according to the invention. Examples 1 to 11 describe emulsions which are stable over a period of 1 year at 20 ° C. or for 4 months at 40 ° C. and contain guerbet non-ionic surfactants.

Comparative examples 12 to 14 describe liquid detergent compositions which contain linear ethoxylated fatty alcohols and do not contain guerbet alcohol ethoxylates as non-ionic surfactants.

TABLE 1

| Components in wt-% | Ex. 1 | Ex. 2 | Ex. 3 | Ex. 4 | Ex. 5 |
|---|---|---|---|---|---|
| Optical brightener (1) | 0.8 | 0.8 | 0.8 | 0.8 | 0.8 |
| Distyryl biphenyl derivate (2) | 0.2 | 0.2 | 0.2 | 0.2 | 0.2 |
| Hydroxyethylidene diphosphonate acid (3) | 2.5 | 2.5 | 2 | 2.5 | 2.5 |
| KOH 50 wt-% | 25 | 25 | 25 | 25 | 0 |
| NaOH 50 wt-% | 0 | 0 | 0 | 0 | 25 |
| Soda | 5 | 5 | 5 | 0 | 5 |
| Water glass 37/40 | 8.5 | 8.5 | 10 | 10 | 8.5 |
| Oleic acid | 0 | 0 | 0 | 0.5 | 0 |
| Cumolsulfonat, 40 wt-% | 4 | 4 | 5 | 0 | 4 |
| Iminodisuccinate sodium salt | 10 | 10 | 10 | 12 | 10 |
| Methyl glycine diacetic acid sodium salt | 5 | 5 | 5 | 6.5 | 5 |
| Citric acid | 0 | 0 | 0 | 0 | 0 |
| Gluconic acid 50 wt-% | 0 | 0 | 0 | 0 | 0 |
| Polycarboxylate (4) | 0 | 0 | 0 | 0 | 0 |
| Alkylether/carboxylate copolymer | 0 | 0 | 0 | 0 | 0 |
| Hydroxyethlendiamin-tetraessigsäure | 0 | 0 | 0 | 0 | 0 |
| Polycarboxylate maleic/acrylic acid copolymer 40 wt-% | 3.5 | 3.5 | 5 | 5 | 3.5 |
| Fatty alcohol. C12-14 + 5EO + 4 PO (5) | 9.5 | 9.5 | 0 | 16 | 9.5 |
| Fatty alcohol. C13-15 + 7EO (6) | 0 | 0 | 0 | 0 | 0 |
| Guerbet alcohol C10-18 + 9EO (7) | 0 | 0 | 3 | 0 | 0 |
| Guerbet alcohol C10-18 + 7EO (8) | 2.5 | 2.5 | 0 | 3 | 2.5 |
| Guerbet alcohol C10 + 3 EO (9) | 7.5 | 7.5 | 20 | 0 | 7.5 |
| Defoamer, Paraffin | 0 | 0 | 0 | 1 | 0 |
| Crosslinked polyacrylic acid polymer (10) | 0.5 | 0.5 | 0.3 | 0.5 | 0.5 |

| Components in wt-% | Ex. 6 | Ex. 7 | Ex. 8 | Ex. 9 | Ex. 10 |
|---|---|---|---|---|---|
| Optical brightener (1) | 0.8 | 0.8 | 0.8 | 0.8 | 1 |
| Distyryl biphenyl derivate (2) | 0.2 | 0.2 | 0.2 | 0.2 | 0 |
| Hydroxyethylidene diphosphonate acid (3) | 0 | 0 | 0 | 2.5 | 0 |
| KOH 50 wt-% | 0 | 25 | 25 | 25 | 25 |
| NaOH 50 wt-% | 25 | 0 | 0 | 0 | 0 |
| Soda | 5 | 0 | 5 | 5 | 5 |
| Water glass 37/40 | 8.5 | 7.5 | 5 | 8.5 | 10 |
| Oleic acid | 0.2 | 0.5 | 0.5 | 0 | 0 |
| Cumolsulfonat, 40 wt-% | 3.5 | 0 | 0 | 0 | 5 |
| Iminodisuccinate sodium salt | 10 | 0 | 0 | 10 | 0 |
| Methyl glycine diacetic acid sodium salt | 5 | 0 | 0 | 0 | 0 |
| Citric acid | 0 | 8 | 8 | 12 | 5 |
| Gluconic acid 50 wt-% | 0 | 10 | 0 | 0 | 2.5 |
| Polycarboxylate (4) | 0 | 0 | 5.5 | 0 | 5 |
| Alkylether/carboxylate copolymer | 0 | 0 | 0 | 0 | 5 |
| Hydroxyethlendiamin-tetraessigsäure | 2.5 | 0 | 0 | 0 | 0 |
| Polycarboxylate maleic/acrylic acid copolymer 40 wt-% | 5 | 5.5 | 5 | 3.5 | 0 |
| Fatty alcohol. C12-14 + 5EO + 4 PO (5) | 16 | 16 | 16 | 9.5 | 11 |
| Fatty alcohol. C13-15 + 7EO (6) | 0 | 0 | 0 | 0 | 0 |
| Guerbet alcohol C10-18 + 9EO (7) | 0 | 0 | 0 | 0 | 3 |
| Guerbet alcohol C10-18 + 7EO (8) | 3 | 3 | 3 | 3 | 3 |
| Guerbet alcohol C10 + 3 EO (9) | 0 | 0 | 0 | 7 | 5 |
| Defoamer, Paraffin | 0 | 0 | 0 | 0 | 0.5 |
| Crosslinked polyacrylic acid polymer (10) | 0.4 | 0.3 | 0.6 | 0.5 | 0.4 |

TABLE 1-continued

| Components in wt-% | Ex. 11 | comp. Ex. 12 | comp. Ex. 13 | comp. Ex 14 |
|---|---|---|---|---|
| Optical brightener (1) | 1 | 1 | 0.8 | 0.3 |
| Distyryl biphenyl derivate (2) | 0 | 0 | 0.2 | 0.1 |
| Hydroxyethylidene diphosphonate acid (3) | 2.5 | 2.5 | 2.5 | 2.5 |
| KOH 50 wt-% | 25 | 25 | 25 | 25 |
| NaOH 50 wt-% | 0 | 0 | 0 | 0 |
| Soda | 5 | 5 | 5 | 0 |
| Water glass 37/40 | 8.5 | 8.5 | 8.5 | 10 |
| Oleic acid | 0 | 0 | 0 | 0 |
| Cumolsulfonat, 40 wt-% | 4 | 4 | 4 | 0 |
| Iminodisuccinate sodium salt | 10 | 10 | 10 | 14.75 |
| Methyl glycine diacetic acid sodium salt | 5 | 5 | 5 | 7.5 |
| Citric acid | 0 | 0 | 0 | 0 |
| Gluconic acid 50 wt-% | 0 | 0 | 0 | 0 |
| Polycarboxylate (4) | 0 | 0 | 0 | 0 |
| Alkylether/carboxylate copolymer | 0 | 0 | 0 | 0 |
| Hydroxyethlendiamin-tetraessigsäure | 0 | 0 | 0 | 0 |
| Polycarboxylate maleic/acrylic acid copolymer 40 wt-% | 5 | 3.5 | 3.5 | 7.5 |
| Fatty alcohol. C12-14 + 5EO + 4 PO (5) | 9.5 | 9.5 | 9.5 | 9.5 |
| Fatty alcohol. C13-15 + 7EO (6) | 0 | 5 | 5 | 0 |
| Guerbet alcohol C10-18 + 9EO (7) | 0 | 0 | 0 | 0 |
| Guerbet alcohol C10-18 + 7EO (8) | 2.5 | 0 | 0 | 0 |
| Guerbet alcohol C10 + 3 EO (9) | 7.5 | 0 | 0 | 0 |
| Defoamer, Paraffin | 0 | 0 | 0 | 0.2 |
| Crosslinked polyacrylic acid polymer (10) | 0.5 | 0.5 | 0 | 0.65 |
| Polyacrylic Polymer (11) | | | 1.5 | 0 |
| fatty alcohol C13-15 + 3EO/10EO (12) | 0 | 0 | 0 | 5 |
| C10 fatty alcohol + 3EO (13) | 0 | 5 | 5 | 5 |
| N-dodecylbenzenesulfonic acid (14) | 0 | 0 | 0 | 0.5 |

All amounts are given in wt-%. The rest up to 100 wt-% is deionized water.
(1) Tinopal DMX/X (Ciba)
(2) Tinopal CBS/X (Ciba)
(3) Dequest 2010
(4) Alcosperse 175 (Alco)
(5) Dehypon LS54 (Cognis)
(6) Lutensol AO 7 (BASF)
(7) Lutensol M9 (BASF)
(8) Lutensol M7 (BASF)
(9) Lutensol XP 30 (BASF)
(10) Carbopol EDT 2691 (Noveon)
(11) Acusol 820 (Rohm & Haas)
(12) Lutensol AO3109 (BASF
(13) Lutensol ON30 (BASF)
(14) Marlon AS3 (BASF)

Example 2

Membrane Compatibility

FIG. 1 shows the membrane compatibility of the composition according to example 11 being compared with the composition according to comparative example 12.

It can be noted that the formulation according to example 11 has a much higher membrane compatibility since the permeate stream for an ultra filtration membrane is much higher compared to the permeate stream according to comparative example 12. The amount for example 11 is even higher compared to the usual standard describing the permeate stream being necessary for ultra filtration membranes, if the composition is defined as membrane-compatible.

For a person skilled in the art it was very surprising that replacing the linear ethoxylated fatty alcohols by branched ethoxylated fatty alcohols would result in an increase of the permeate stream. A skilled person would rather expect that the use of branched non-ionic surfactants would result in lower permeate streams due to the higher volume of the branched carbon chains in the guerbet non-ionic surfactants.

Example 3

Foam Test

In this example the foaming behavior of the composition in example 1 of table 1 without a defoamer is compared with the comparative example 14 comprising a defoamer.

The following table 2 shows the result of the foam test.

TABLE 2

Foam test according to Gotte at 70° C. with 3 g/l composition and soft water

| Min | Example 1 height of foam (mm) | Comp. Ex. 14 height of foam (mm) |
|---|---|---|
| 0 | 0 | 0 |
| 2 | 30 | 270 |
| 4 | 40 | 300 |
| 6 | 40 | 340 |
| 8 | 40 | 400 |
| 10 | 40 | 420 |
| 12 | 40 | 420 |

It can be seen that the composition according to the invention in example 1 comprising no defoaming agent shows a better foaming behavior compared to the composition in comparative example 14 with a defoaming agent.

Example 4

Storage Stability

TABLE 3

Storage Stability of Concentrate emulsion

| Composition | after 16 weeks at 5° C. | after 16 weeks at 20° C. | after 16 weeks at 40° C. |
|---|---|---|---|
| Example 1 (Tab. 1) | liquid, no dephasing | liquid, no dephasing | liquid, no dephasing |
| Comp. Ex 13 (Tab. 1) | dephasing (after 1 week) | dephasing (after 5 days) | dephasing (after 3 days) |

It can be seen that the composition of example 1 does not show any dephasing even after 16 weeks at 40° C. In contrast the comparative example 13 shows a dephasing at 5° C. after 1 week and at 40° C. after three days. The composition according to the comparative example 13 is only stable for 5 days at room temperature. After five days the composition is dephased. Therefore comparative example 13 is less storage-stable.

Example 5

Primary Washing Performance

The liquid detergent concentrate according to example 1 in table 1 was compared with the comparative example 14 in table 1. The two compositions were tested with respect to their washing performance using a common washing cycle at 50° C. and 60° C. with pre-wash and artificial soil strips as commercially available like those by WFK. For testing the primary performance 2 g/l of the concentrate of comparative example 1 was used. The primary performance was tested with soft water (0° dH (deutsche Härte)) The results are shown in table 4.

TABLE 4

| | Primary Performance | |
|---|---|---|
| | Procedure | |
| Composition | Soft water (0°dH), 50° C., 2 g/l detergent concentrate Washable soil* (% remission value) | Soft water (0°dH), 60° C., 2 g/l detergent concentrate Washable soil* (% remission value) |
| Example 1 (Tab. 1) | 58 | 59 |
| Comp. Ex 14 (Tab. 1) | 60 | 62 |

*representing soil of grease, oil, pigment

The values shown in table 4 indicate that the composition according to the invention has a similar washing performance in soft water as the comparative composition.

The invention claimed is:

1. A liquid detergent concentrate composition comprising an emulsion having an aqueous phase and an oil phase, the composition comprising, based on the whole concentrate:

1 to 50 wt-% of one or more alkalinity source;

1 to 60 wt-% of at least two guerbet alcohol ethoxylates of the formula $R_1$—$(OC_2H_4)_n$—OH, wherein $R_1$ is a branched $C_8$ to $C_{20}$ alkyl group and n is from 2 to 10;

1 to 30 wt-% of a linear alkoxylated fatty alcohol of the formula $R_2$—$(OC_2H_4)_x$—$(OC_3H_6)_y$—OH, wherein $R_2$ is a linear $C_{10}$ to $C_{16}$ group and x is from 3 to 7 and y is from 3 to 7;

0.01-10 wt-% of one or more crosslinked or partly crosslinked polyacrylic acid or polymethacrylic acid or mixtures thereof;

and the rest up to 100 wt-% is water.

2. The liquid detergent concentrate according to claim 1, wherein the concentrate comprises less than 1 wt-% of a linear alcohol ethoxylate of the formula $R_3$—$(OC_2H_4)_Z$—OH, wherein $R_3$ is a linear $C_{10}$ to $C_{18}$ alkyl group and z is from 3 to 9.

3. The liquid detergent concentrate, according to claim 1, wherein the alkalinity source is an alkalihydroxide.

4. The liquid detergent concentrate according to claim 1, wherein the crosslinker for the crosslinked polyacrylic acid or polymethacrylic acid is a polyalkenyl polyether compound.

5. The liquid detergent concentrate according to claim 1, wherein the composition does not contain a cationic surfactant.

6. The liquid detergent concentrate according to claim 1, wherein the amount of alkyl polyglycoside in the detergent is less than 1 wt-%.

7. The liquid detergent concentrate according to claim 1, wherein the amount of fatty acid soap in the detergent is less than 1 wt-%.

8. The liquid detergent concentrate according to claim 1, wherein the amount of ethylene diamine tetraacetic acid, nitrilo triacetic acid, hydroxy ethylene diamine tetraacetic acid in the detergent is less than 1 wt-%.

9. The liquid detergent concentrate according to claim 1, wherein the detergent concentrate has a viscosity range of from 500 to 10,000 mPas at 20° C. measured at 20 revolutions per minute on a Brookfield RVT viscometer with spindle 2.

10. The liquid detergent concentrate according to claim 1, wherein the concentrate is membrane compatible.

11. The liquid detergent concentrate according to claim 1, wherein the concentrate comprises less than 2.5 wt-% of phosphor containing compounds.

12. The liquid detergent concentrate according to claim 1, wherein the concentrate comprises a complexing agent selected from the group consisting of iminodisuccinate salt, methyl glycine diacetic acid salt, and combinations thereof.

13. The liquid detergent concentrate according to claim 12, wherein the ratio of the iminodisuccinate salt to methyl glycine diacetic acid salt is from 6 to 1 to 1 to 1.

14. The liquid detergent concentrate according to claim 1, wherein the droplet size of the emulsion is less than 25 μm.

15. The liquid detergent concentrate according to claim 1, wherein the detergent does not contain any bleaching agent.

16. The liquid detergent concentrate according to claim 1, wherein the detergent contains 5 to 40 wt-% water.

17. The liquid detergent concentrate according to claim 1, wherein the detergent additionally comprises additives selected from the group consisting of builder, pH modifier, antimicrobial agents, abrasives, anti- redeposition agents, sequestrants, softener, conditioner, viscosity modifying agents, wetting modifying agents, enzymes, optical brighteners, and mixtures thereof.

18. The liquid detergent concentrate according to claim 1, wherein the guerbet alcohol ethoxylate is a mixture of two different guerbet alcohol ethoxylates of the formula $R_1$—$(OC_2H_4)_n$—OH, wherein for the first guerbet alcohol ethoxylate $R_1$ is a branched $C_{10}$ to $C_{18}$ alkyl group and n is from 5 to 10 and for the second guerbet alcohol $R_1$ is $C_8$ to $C_{12}$ and n is 2 to 4.

19. A stable aqueous use solution comprising the liquid detergent concentrate according to claim 1 in water in a concentration of from 0.1 to 25 wt-% based on the whole use solution.

20. A method for washing textiles comprising:

providing the liquid detergent according to claim 1, diluting the liquid detergent to a stable aqueous use solution to a concentration of 0.1 to 25 wt-% based on the total use solution, and washing the textiles in an institutional or a household washing machine in the use solution.

21. The method according to claim 20, wherein the waste water accumulated during the washing process or parts thereof is purified using a membrane filter.

22. The detergent concentrate composition of claim 3, wherein the alkalihydroxide comprises NaOH, KOH, and combinations thereof.

* * * * *

UNITED STATES PATENT AND TRADEMARK OFFICE

CERTIFICATE OF CORRECTION

PATENT NO. : 8,062,381 B2
APPLICATION NO. : 12/663132
DATED : November 22, 2011
INVENTOR(S) : Shamayeli et al.

It is certified that error appears in the above-identified patent and that said Letters Patent is hereby corrected as shown below:

Front page, (57) Abstract, line 11: “acid Q or” should read --acid or--

Signed and Sealed this
Twenty-eighth Day of August, 2012

David J. Kappos

David J. Kappos
*Director of the United States Patent and Trademark Office*